United States Patent [19]

Atkinson

[11] 4,403,493

[45] Sep. 13, 1983

[54] METHOD FOR NECKING THIN WALL METALLIC CONTAINERS

[75] Inventor: Michael L. Atkinson, Arvada, Colo.

[73] Assignee: Ball Corporation, Muncie, Ind.

[21] Appl. No.: 325,693

[22] Filed: Nov. 30, 1981

Related U.S. Application Data

[63] Continuation of Ser. No. 120,419, Feb. 12, 1980, abandoned, which is a continuation-in-part of Ser. No. 51,573, Jun. 25, 1979, abandoned.

[51] Int. Cl.[3] ..... B21D 22/00

[52] U.S. Cl. ..... 72/356; 72/348; 72/354; 72/370

[58] Field of Search ..... 72/347, 348, 349, 354, 72/356, 370; 220/83; 413/1, 69

[56] References Cited

U.S. PATENT DOCUMENTS

| | | | |
|---|---|---|---|
| 3,765,351 | 10/1973 | Kybacki | 72/379 |
| 3,786,957 | 1/1974 | Hilgenbrink | 220/83 |
| 3,964,413 | 6/1976 | Saunders | 72/370 |
| 3,995,572 | 12/1976 | Saunders | 72/348 |
| 4,173,883 | 11/1979 | Boik | 72/354 |

*Primary Examiner*—Leon Gilden

*Attorney, Agent, or Firm*—Gilbert E. Alberding

[57] ABSTRACT

The present invention relates to methods for reducing the open end of drawn and ironed containers such as beverage cans (20). It is desirable to provide a maximum reduction in diameter of the open end (36) in order to reduce the quantity of material in the lid (24); but previous forming methods have resulted in localized buckling in the reduced diameter portion (58) and/or crumpling of the transition portion (60). The present invention has solved the localized buckling and crumpling problems by a step wherein both the reduced diameter portion (58) and the transition portion (60) are reformed within controlled limits to provide a new reduced diameter portion (82) and a new curvilinear transition portion (84). Principal uses include the manufacture of beverage cans.

13 Claims, 9 Drawing Figures

METHOD FOR NECKING THIN WALL METALLIC CONTAINERS

RELATED PATENT APPLICATION

This is a continuation of my copending patent application Ser. No. 120,419, filed Feb. 12, 1980 and now abandoned which in turn is a continuation-in-part of my patent application Ser. No. 51,573, filed June 25, 1979, now abandoned.

TECHNICAL FIELD

The present invention relates to a method for necking cylindrical metallic shells, and more particularly to a method for obtaining maximum percentages of reductions in the open ends of thin wall metallic containers with a minimum number of forming steps.

BACKGROUND ART

Drawn and ironed seamless beverage cans, whether fabricated from aluminum or steel, customarily are reduced in diameter proximal to the open end prior to attaching the lid or top. This reduction in diameter near the top end or open end is done to achieve a reduction in the quantity of material that is required to fabricate the lid. The percentage in material saving and the potential cost savings becomes apparent when it is realized that the thickness of the material for the lid may be 0.013 inches or more, whereas the thickness of the wall material may be only 0.005 to 0.008 inches thick and the savings in material is a function of the square of the reduction in diameter.

Therefore, it is advantageous to reduce the open end of a drawn and ironed beverage can to as small a diameter as can be reasonably achieved and as small as will leave sufficient space for a pull-tab opener. However, the extremely thin walls of beverage cans present difficulties in the necking operation, namely localized buckling of the material inwardly rather than uniform compressive yielding of the material in conformity to meeting progressively reduced diameters in the necking die.

The development of drawn and ironed aerosol cans has also presented a need for large percentage reductions in the open ends of the cans. However, attempts to obtain a large percentage reduction in the open end of seamless, drawn and ironed containers, such as beverage cans and aerosol cans, has resulted in wrinkling or localized buckling.

It has been customary to utilize a punch portion of the die to minimize this localized buckling and to maximize the percentage of reduction in diameter that can be achieved without wrinkling. This general principle is embodied in FIGS. 7–10 of Saunders, U.S. Pat. No. 3,995,572. However, it should be realized that the punch must be retractable from the open end of the container; so it cannot support the open end of the container as the material is deformed inwardly to prevent localized buckling. Instead, it can only prevent localized buckling inwardly of the reduced diameter that is being formed.

This tendency toward buckling during necking operations, combined with the extreme thinness of the material in beverage cans, limits percentage reductions to approximately 4.3 percent in steel containers having a wall thickness of 0.005 to 0.008 inches. Attempts to obtain larger percentages in reduction of diameter by the use of additional forming steps have resulted in a general crumpling of the shoulder or transition portion when the objective has been to both further reduce a previously reduced diameter portion and to reform a previously formed transition portion.

Saunders, in the aforementioned patent, has avoided both the localized wrinkling and shoulder crumpling problems by teaching the forming of a plurality of reduced diameter portions to arrive at a greatly reduced diameter of opening.

Hilgenbrink, in FIG. 4 of U.S. Pat. No. 3,786,957, teaches a die construction for supporting the open end and a first reduced diameter portion of the die while reforming a longitudinal portion of the first reduced diameter portion into a second reduced diameter portion that is both smaller in diameter and shorter than the first reduced diameter portion. Thus both Saunders and Hilgenbrink resort to a plurality of reduced diameter portions to avoid the problems of localized wrinkling and shoulder cumpling occurring during a second or subsequent necking or forming step.

While Hilgenbrink and Saunders have made advances in the art by providing containers that achieve the required reduction in diameter of the opening by a plurality of reduced diameter portion, their solution is not entirely satisfactory for use with beverage cans because the plurality of reduced diameter portions results in an appreciable loss of container volume for a given length and diameter of a container. Therefore, for containers where the number of fluid ounces in a container has been firmly established, as has been done with regard to carbonated soft drinks, and where the size of the containers is limited by automatic vending machines, the advantages of a material saving in a reduced diameter top are largely offset by the loss of standard volume capacities and/or standard container sizes.

In contrast to the prior art, the present invention achieves large reductions in the open end of the container while minimizing the number of reduced diameter portions, providing a savings both in metal and cost of the lids or tops, maintaining standard volumetric capacities in standardized sizes of containers, and minimizing the total number of forming steps.

DISCLOSURE OF INVENTION

In accordance with the broader aspects of the present invention, there is provided a method for maximizing the percentage reduction in the opening of a drawn and ironed seamless container of the type having a cylindrically shaped wall that is metallic and that is less than 0.010 inches thick, for minimizing the number of reduced diameter portions that are required to achieve the required percentage reduction in opening diameter, and for minimizing the number of forming steps.

In a first forming step, a first temporary reduced diameter portion is formed proximal to and juxtaposed to the open end of the container, and a first temporary curvilinear transition portion is formed intermediate of the temporary reduced diameter portion and the remainder of the cylindrically shaped wall. The percentage reduction of this first step is maximized, being just under the percentage reduction that would cause localized buckling.

In a second forming step, the first temporary reduced diameter portion is reformed by a reduction of preferably 50 percent, but not more than 65 percent of the percentage of reduction of the first step. Further, the first temporary curvilinear transition portion is reformed to provide a first curvilinear transition portion that is intermediate of the first reduced diameter portion and the remainder of the cylindrically shaped wall.

If a still larger percentage of reduction is required, the container can be double necked by repeating the first forming step or both the first and second forming steps, reforming a longitudinal portion of the first reduced diameter portion to form both a second reduced diameter portion and a second curvilinear transition portion. Alternately, subsequent forming steps, in accordance with the percentage limits of a step two, can be used to achieve larger percentage reductions while maintaining a single necked configuration.

In accordance with this invention, a method is disclosed for forming at least two reduced diameter portions in an open end of a metal cylindrical body, said method comprising deflecting inwardly the open end of the body by a first die forming means including a supporting bore with a curvilinear transition portion leading into a necking bore, said supporting bore conforming substantially to the external diameter of the body, said deflecting inwardly causing a reduction in the diameter of the open end on the order of about 3.5 percent to about 3.8 percent of the diametrical reduction, further deflecting inwardly the reduced open end by a second die forming means to further reduce the diameter of the reduced open end, said second die forming means including a second supporting bore with a second curvilinear transition portion leading into a second necking bore, said second curvilinear transition portion having a sloping surface about twice that of the first curvilinear transition portion and redeflecting the previous diameter formed by the first inward deflection by bringing the previous diameter into conformity with the entire second die forming means, the second deflection reducing the diameter on the order of between about 1.69 percent to about 1.7 percent of the diametrical reduction, and thereafter deflecting inwardly in a final stage the further reduced open end by a third die forming means comprising a short supporting portion conterminous with a short transition portion leading into a short necking bore, said further reduced open end being brought into conformity with the short supporting portion, transition portion and necking bore to reduce the final diameter thereof on the order of between about 3.8 to about 4.1 percent of the diametrical reduction.

The advantages of the present invention include reduction in the quantity of material that is required for the lid of beverage containers by providing a large reduction in the diameter of the open end of a container, and minimization of the number of reduced diameter portions that are required for a given reduction in the open end of a container, thereby maintaining standard fluid volume, standard container package size, and standard appearance, and minimizing the total number of forming steps in order to achieve total cost savings that are commensurate with the reduction in cost of the lid.

The aforementioned and other advantages of the present invention and the manner of attaining them will become more apparent and the invention will be best understood by reference to the following description of an embodiment of the invention taken in conjunction with the accompanying drawings.

BEST MODE FOR CARRYING OUT THE INVENTION

Figure 1:
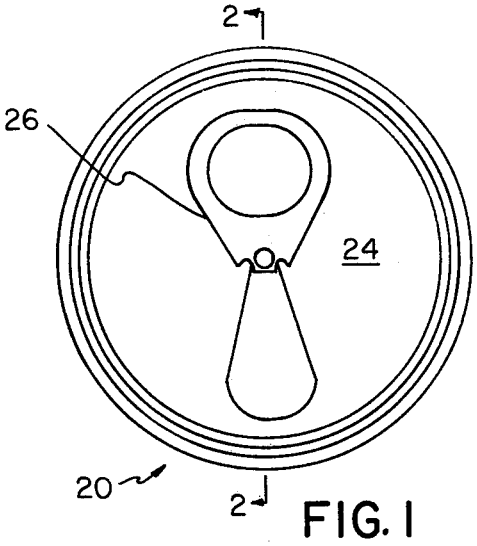
FIG. 1 is a top view of a beverage can.
Figure 2:
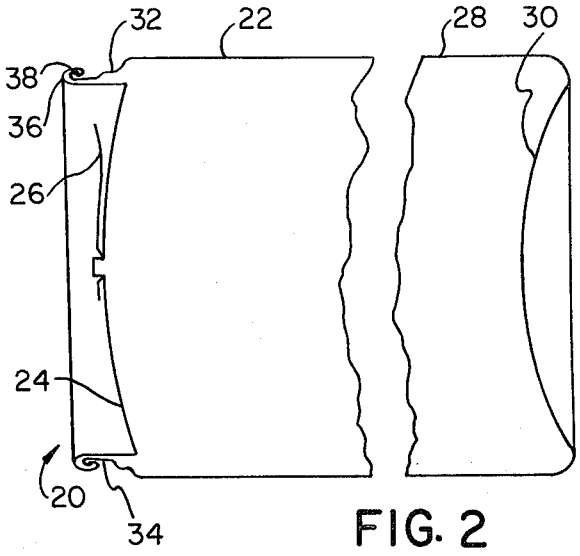
FIG. 2 is a cross-sectional view of the beverage can of FIG. 1 taken substantially as shown by section line 2—2 of FIG. 1.

Referring now to the drawings, and more particularly to FIGS. 1 and 2, a beverage can 20 includes a drawn and ironed seamless container 22, a top or lid 24, and a pull-tab opener 26. The drawn and ironed seamless container 22 includes a cylindrically shaped wall 28, a domed bottom 30, a first necked portion or reduced diameter portion 32, and a second necked portion or reduced diameter portion 34. The top or lid 24 is double seamed to a top end or open end 36 of the cylindrical container 22 by a bead 38.

Figure 3:
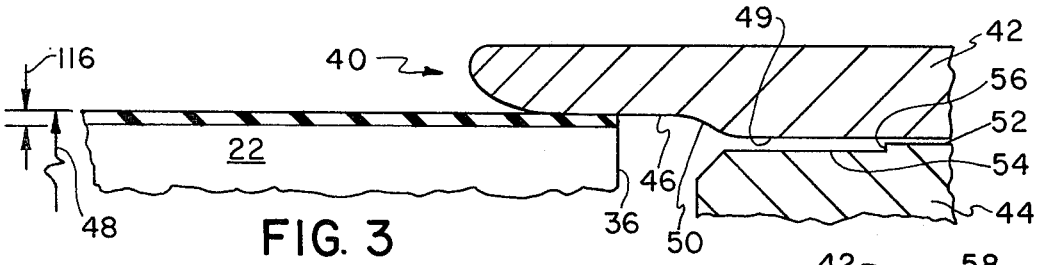
FIG. 3 is a partial cross section of a necking die set for necking the open end of a container and a partial cross section of the open end of a container prior to the first necking step.
Figure 4:
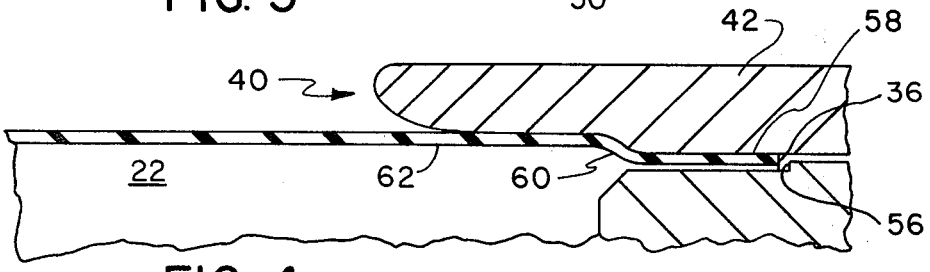
FIG. 4 is a partial cross section of the necking die set of FIG. 3, showing the open end of the container as formed within the die set during the first necking step.

Referring now to FIGS. 3 and 4, a first step necking die set 40 includes a first step necking die 42 and a first step punch 44. The first step necking die 42 includes a supporting bore 46 that is substantially the same diameter as a diameter 48 of the container 22. The first step necking die 42 also includes both a first step necking bore 49 and a first step curvilinear transition portion 50; and the first step punch 44 includes both a cylindrical guiding portion 52 that is slidably fitted into the first step necking bore 49, and a cylindrical first step supporting portion 54.

The top or open end 36 of the cylindrical container 22 is shown in FIG. 3 prior to entry into the die set 40; and in FIG. 4 the end 36 is shown abutting a knockout shoulder 56 of the first step punch 44. In the FIG. 4 view, a temporary neck or temporary reduced diameter portion 58 has been formed on the container 22 proximal to the open end 36 thereof and a temporary curvilinear transition portion 60 has been formed intermediate of the temporary reduced diameter portion 58 and a remainder 62 of the cylindrically shaped wall 28.

Figure 5:
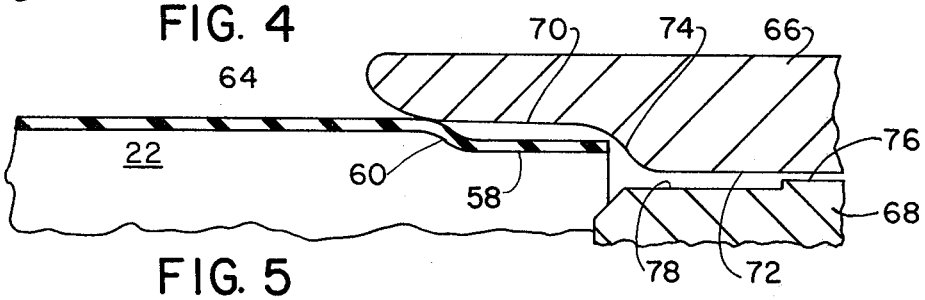
FIG. 5 is a partial cross section of a second necking die set, showing the open end of the container of FIG. 4 subsequent to the first necking or forming step of FIG. 4 and prior to a second necking or forming step.
Figure 6:
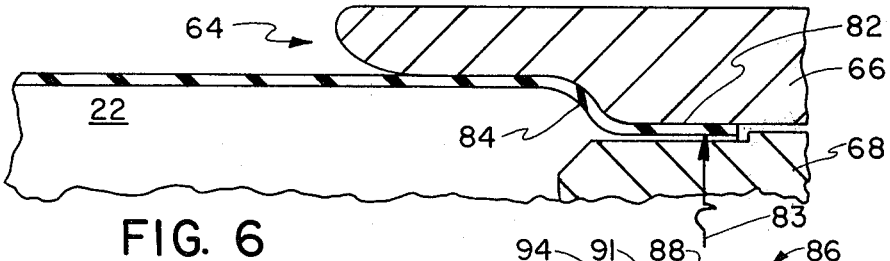
FIG. 6 is a partial cross section of the necking die set of FIG. 5 showing the open end of the container at the completion of the second forming step.

Referring now to FIGS. 5 and 6, a second step necking die set 64 includes a second step necking die 66 and a second step punch 68. The second step necking die 66 includes a supporting bore 70 that is substantially the same diameter as the supporting bore 46 of FIG. 3, a second step necking bore 72 that is smaller in diameter than the first step necking bore 49, and a second step curvilinear transition portion 74. The second step punch 68 includes a cylindrical guiding portion 76, a cylindrical second step supporting portion 78, and a knockout shoulder 80.

Figure 7:
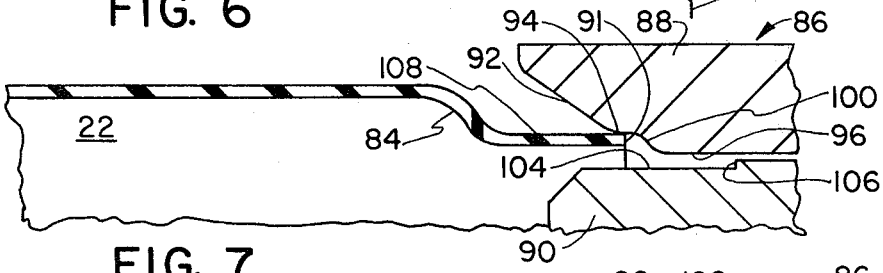
FIG. 7 is a partial cross section of a necking die set for double necking the open end of a container, showing a partial cross section of the open end of a container that has previously received two forming operations producing a single neck as shown in FIG. 6.

In FIGS. 4 and 5, the temporary neck or temporary reduced diameter portion 58 has an outside diameter that is substantially equal to the first step necking bore 49 of FIG. 3; but in FIG. 6, the temporary reduced diameter portion 58 has been reformed to provide a first neck or first reduced diameter portion 82 and to provide a reduced diameter opening 83; and the temporary curvilinear transition portion 60 has been reformed to provide a first curvilinear transition portion 84 of FIGS. 6 and 7 that substantially conforms with the curvilinear transition portion 74 of the second step necking die 66.

Figure 8:
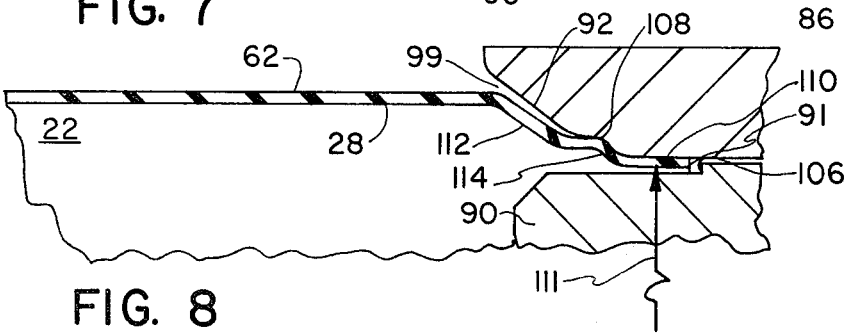
FIG. 8 is a partial cross section of the necking die set of FIG. 7, showing a partial cross section of a container that has been double necked proximal to the open end thereof.

Referring now to FIGS. 7 and 8, a double necking die set 86 includes a double necking die 88 and a punch 90. The double necking die 88 includes a first neck supporting bore 94, a second neck necking bore 96, and curvilinear transition portion 100 that connects said bores 94 and 96. The punch 90 includes a cylindrical guiding portion 102, a cylindrical supporting portion 104, and a knockout shoulder 106.

In FIG. 8, a portion of the first neck or reduced diameter portion 108 of FIG. 7 has been reformed to provide a second neck or reduced diameter portion 110 and a reduced diameter opening 111 whereby the container 22 of FIG. 8 not only includes reduced diameter portion 108 and 110 but also includes curvilinear transition portions 112 and 114 that are disposed between an end 36 of the container 22 and the remainder 62 of the cylindrically shaped wall 28.

It will be appreciated that the cylindrically shaped wall 28 of container 22 is unsupported during this final necking-in stage and that it is only the reduced diameter portion 108 that contacts the first neck supporting bore 94 of the double necking die 88. In effect the terminal end 91 of the reduced diameter portion 108 is guided radially over the neck supporting bore 94 and thereafter deflected inwardly via the curvilinear transition portion 100 and thence over the second neck supporting bore 96 until the terminal end 91 extends substantially adjacent to the knockout shoulder 106. In the necking-in operation the curvilinear transition portion 112 remains away from tapering face 92 whereby a small gap or clearance 99 between portion 112 and face 92 is formed. In the final forming die it is to be particularly noted that the short supporting and transition portions (94 and 100) form conterminous surfaces whereby the reduced end of a container is guided and supported over surfaces in a uniform and even fashion.

Referring again to FIGS. 1–3, in drawn and ironed seamless containers for use in the beverage industry, such as the container 22, the thickness 116 of the cylindrically shaped wall 28 is typically less than 0.010 inches and is more customarily in the range of 0.005 to 0.008 inches. Because of the extreme thinness of the wall 28, as the open end 36 of the container 22 of FIG. 3 is forced into the curvilinear transition portion 50 of the first step necking die 42, there is tendency for the material of the wall 28 to locally buckle proximal to the end 36 rather than undergoing uniform circumferential yielding. The first step supporting portion 54 limits the localized buckling of the container 22; but even with this limitation of localized buckling, it is impractical to attempt to neck seamless containers 22 with these extremely thin walls more than 4.3 percent when the container has a steel wall that is between 0.005 and 0.008 inches thick.

Further, it has been found that it is impossible to reform the reduced diameter portion 58 and the curvilinear transition portion 60 and to achieve even a 3.6 percent reduction in a second forming step because of crumpling and collapsing of the container 22 in the area of the curvilinear transition portion 60.

Keeping in mind these limitations in percentage reductions that can be achieved in forming and/or reforming of reduced diameter portions, it is desirable to reduce a 2.608 inch diameter container to 2.372 inches proximal to the open end. This represents a total percentage reduction of 9.04 percent. While it is possible to attain this reduction by necking the container in three steps and by providing three different reduced diameter portions, it is desirable to limit the total number of reduced diameter portions to two; because the use of three reduced diameter portions results in an excessively long neck, reducing the fluid volume of the container. By carefully proportioning the percentage reductions in the various forming steps, it is possible to obtain the required percentage reduction while limiting the number of reduced diameter portions to two. An example of practical limits for each step are shown in Table 1:

TABLE 1

| Step No. | Beginning Dia (in.) | Finish Dia (in.) | % Reduction |
|---|---|---|---|
| 1 | 2.608 | 2.517 | 3.48 |
| 2 | 2.517 | 2.473 | 1.74 |
| 3 | 2.473 | 2.372 | 4.08 |

In like manner, it is desirable to reduce a beverage can having a 2.480 inch diameter cylindrically shaped wall to 2.256 inches proximal to the open end of the container in order to save material in and to reduce the cost of the lid or top 24. An example of practical limits for each step is shown in Table 2:

TABLE 2

| Step No. | Beginning Dia (in.) | Finish Dia (in.) | % Reduction |
|---|---|---|---|
| 1 | 2.480 | 2.387 | 3.75 |
| 2 | 2.387 | 2.346 | 1.71 |
| 3 | 2.346 | 2.225 | 3.83 |

In both Table 1 and Table 2, step number 1 refers to the first forming step wherein both the temporary reduced diameter portion 58 and the temporary curvilinear transition portion 60 of FIG. 4 are formed, step number 2 refers to reforming both the temporary reduced diameter portion 58 and the temporary curvilinear transition portion 60 into both the reduced diameter portion 108 and the curvilinear transition portion 112 of FIG. 7, and step number 3 refers to reforming a longitudinal portion of the reduced diameter portion 108 to provide a second reduced diameter portion 110 and a second curvilinear transition portion 114.

Figure 9:
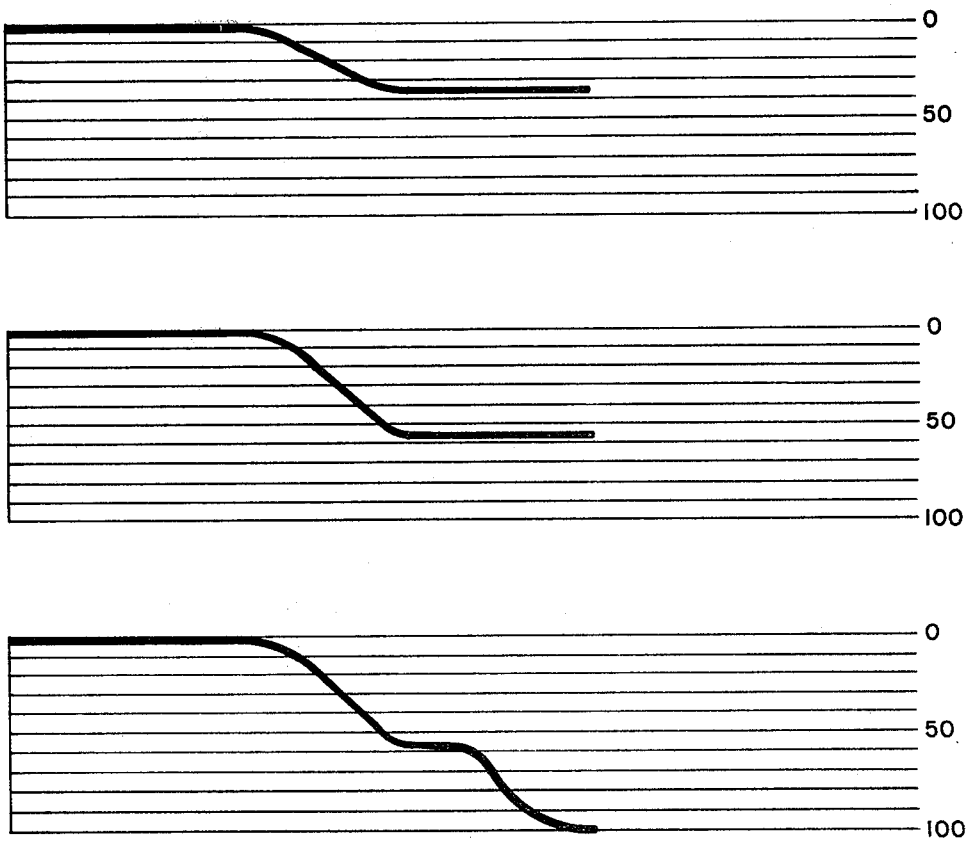
FIG. 9 is a diagrammatic representation to show the progressive series of three steps as viewed through the open end section of a metal container in accordance with the subject invention.

FIG. 9 depicts the percentage of total reduction (as opposed to diametrical reductions) in accordance with this invention. As noted, FIG. 9(*a*) shows a cross section having about a 40 percent total reduction, step two (FIG. 9(*b*)) showing about an 18 percent total reduction for a total of about 59 percent total reduction for the first two stages and thereafter for a 44 percent final percentage of total reduction, FIG. 9(*c*).

A wide range of ferrous and aluminum-base alloys may be used for container stock to produce the containers in accordance with the subject invention. The preferred ferrous or steel stock are those of low-carbon killed steels of commercial drawing quality. They are of the continuous or ingot casted types wherein their killing media may be either aluminum or silicon. A preferred type of steel is the continuously-casted steel having various annealed tempers, such as the T-I annealed temper. Although a wide range of aluminum-base alloys may be employed for the container stock of the subject invention, a preferred aluminum-base alloy is 3004 H-19 aluminum-base stock of good drawing and ironing quality.

In summary, the present invention provides advantages of economy in a highly competitive industry by providing a maximum reduction in the diameter of the open end of a beverage can while minimizing the required number of forming steps and the number of reduced diameter portions, thereby providing overall cost savings while maintaining standard fluid capacities, standard container sizes, and standard container appearance.

While there have been described above the principles of the present invention in connection with a specific article of manufacture and specific manufacturing steps, it is to be clearly understood that the description is made only by way of example; and the scope of the invention is to be defined by the appended claims.

INDUSTRIAL APPLICABILITY

The present invention is industrially applicable to the manufacture of drawn and ironed seamless containers that include a cylindrically shaped wall of thin metal, and it is more particularly applicable to beverage cans in which the thickness of the cylindrically shaped wall is between 0.005 and 0.008 inches and in which the diameter of the lid of the can is smaller than the diameter of the cylindrically shaped wall.

What is claimed is:

1. A method of forming at least two reduced diameter portions in a drawn and ironed seamless body having a cylindrically shaped sidewall, an internally formed bottom and an open end, said method comprising deflecting inwardly the open end of the body into contact with first die forming means including a supporting bore with a curvilinear transition portion leading into a necking bore, said supporting bore conforming substantially to the external diameter of the body, said deflecting inwardly causing a reduction in the diameter of the open end on the order of about 3.5 percent to about 3.8 percent over a predetermined length, further deflecting inwardly the reduced open end only over the same predetermined length by a second die forming means to further reduce the diameter of the reduced open end, said second die forming means including a second supporting bore with a second curvilinear transition portion leading into a second necking bore, said second curvilinear transition portion contacting directly and turning the open end of the body along a sloping surface to redeflect the previous diameter formed by the first inward deflection and bringing the previous diameter into conformity with the entire second die forming means, the second deflection reducing the diameter along the predetermined length on the order of between about 1.69 percent to about 1.7 percent, and thereafter deflecting inwardly in a final stage a length less than the predetermined length by a third die forming means comprising a short supporting portion conterminous with a short transition portion leading into a short necking bore, said further reduced open end being brought into comformity with the short supporting portion, transition portion and necking bore to reduce the final diameter thereof on the order of between about 3.8 to about 4.1 percent.

2. A method as recited in claim 1, wherein the redeflecting the previous diameter forms an annular portion having a substantially curvilinear cross section.

3. A method as recited in claim 2, wherein the annular portion formed during redeflecting is momentarily substantially unsupported upon engaging said second die forming means.

4. A method as recited in claim 1 wherein the steel cylindrical body is a low-carbon killed steel.

5. A method for producing a reduced diameter opening proximal to one end of a drawn and ironed seamless container of the type having a cylindrically shaped wall that is metallic and that is less than 0.010 inches thick, by producing a first reduced diameter portion that is disposed proximal to an open end of said container and by producing a first curvilinear transition portion that is disposed intermediate of and juxtaposed against both the remainder of said cylindrically shaped wall and said reduced diameter portion, and for minimizing the number of forming steps, which method comprises forming a temporary reduced diameter portion that is proximal to said open end of said container and that comprises a smaller percentage of diametral reduction in said cylindrically shaped wall than that which would result in localized buckling in said temporary reduced diameter portion, and forming a temporary curvilinear transition portion that is disposed intermediate of said temporary reduced diameter portion and said remainder of said cylindrically shaped wall, in a first step said forming of said diameter and transition portions being over a predetermined length; and reforming said temporary reduced diameter portion by a percentage reduction that is less than 65 percent of the percentage reduction of said first step to form a first reduced diameter portion, and reforming said temporary curvilinear transition portion to form a first curvilinear transition portion that blends said reformed reduced diameter portion into said remainder of said cylindrically shaped wall, said reforming of said diameter and transition in a second step portions being over the same predetermined length.

6. A method for producing a reduced diameter opening proximal to an open end of a drawn and ironed seamless container, of the type that has a cylindrically shaped wall that is metallic and that is less than 0.010 inches thick, by necking down a portion of said wall to provide at least one reduced diameter portion and to provide at least one curvilinear transition portion that is intermediate of said reduced diameter portion and the remainder of said cylindrically shaped wall, and for achieving the greatest percentage of diametral reduction of said reduced diameter opening with the fewest number of forming steps while minimizing the total number of said reduced diameter portion and the total number of said curvilinear transition portions, which method comprises forming a temporary reduced diameter portion that is at least 3.0 percent smaller than the diameter of said cylindrically shaped wall, and forming a temporary curvilinear transition portion that is disposed intermediate of the temporary reduced diameter portion and said remainder of said cylindrically shaped wall, said forming of said diameter and transition portions being over a predetermined length in a first step; and reforming said temporary reduced diameter portion into a first reduced diameter portion by reducing said temporary reduced diameter portion by at least 1.5 percent, and reforming said curvilinear transition portion to blend said first reduced diameter portion into said remainder of said cylindrically shaped wall, said reforming of said diameter and transition portions being over the same predetermined length, in a second step.

7. A method for producing a first reduced diameter portion of more than 4.8 percent diametral reduction proximal to an open end of a drawn and ironed seamless container of the type having a cylindrically shaped wall that is metallic and that is less than 0.010 inches thick, and for producing a single curvilinear transition portion between said first reduced diameter cylindrical portion and the remainder of said cylindrically shaped wall in two forming steps, which method comprises forming a temporary reduced diameter portion that is 3.0 to 4.3 percent smaller than said remainder of said cylindrically shaped wall, and forming a temporary curvilinear transition portion that is disposed intermediate of said temporary reduced diameter portion and said remainder of said cylindrically shaped wall, said forming of said diameter and transition portions being over a predetermined length; and forming said first reduced diameter portion and said first curvilinear transition portion by reforming said temporary reduced diameter portion to said more than 4.8 percent diametral reduction than said remainder of said cylindrically shaped wall, and by reforming said temporary curvilinear transition portion into said first curvilinear transition portion, said reforming of said diameter and transition portions being over the same predetermined length.

8. A method as claimed in claims 5, 6, or 7 in which said reforming of said temporary reduced diameter portion into said first reduced diameter portion comprises moving said open end of said container and said temporary reduced diameter portion of said container into a supporting bore of a necking die that is substantially the same diameter as said temporary reduced diameter portion, forcing said temporary reduced diameter portion into a necking bore of said necking die to reform said temporary reduced diameter portion into said first reduced diameter portion, and by inserting a punch inside said open end and into said reduced diameter portion to minimize localized wrinkling of said reduced diameter portion during said reforming step.

9. A method as claimed in claims 5, 6, or 7 in which said wall comprises steel.

10. A method as claimed in claims 5, 6, or 7 in which said wall comprises aluminum.

11. A method as claimed in claims 5, 6, or 7 in which said cylindrically shaped wall is less than 0.008 inches thick.

12. A method as claimed in claim 6 in which said temporary reduced diameter portion of said first step is between 3.3 and 4.3 percent smaller than said remainder of said container; and said temporary reduced diameter portion is reduced from 1.68 to 2.75 percent in said second step.

13. A method as claimed in claim 7 in which said temporary reduced diameter portion is 3.3 to 4.3 percent smaller than said remainder of said container; and said first reduced diameter portion is 5.0 to 7.1 percent smaller than said remainder of said container.

* * * * *